US009746260B2

(12) United States Patent
Steinbauer et al.

(10) Patent No.: US 9,746,260 B2
(45) Date of Patent: Aug. 29, 2017

(54) HEAT EXCHANGER WITH SECTIONS

(75) Inventors: Manfred Steinbauer, Raisting (DE); Christiane Kerber, Pocking (DE); Markus Hammerdinger, Tacherting (DE); Rainer Fluggen, Bichl (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 971 days.

(21) Appl. No.: 13/446,383

(22) Filed: Apr. 13, 2012

(65) Prior Publication Data

US 2012/0261088 A1 Oct. 18, 2012

(30) Foreign Application Priority Data

Apr. 14, 2011 (DE) ..... 10 2011 017 031

(51) Int. Cl.

| | |
|---|---|
| ***F28F 27/02*** | (2006.01) |
| ***F28D 7/16*** | (2006.01) |
| ***F28F 7/02*** | (2006.01) |
| ***F28D 7/00*** | (2006.01) |
| ***F28D 7/02*** | (2006.01) |

(52) U.S. Cl.

CPC ..... *F28F 27/02* (2013.01); *F28D 7/0083* (2013.01); *F28D 7/024* (2013.01); *F28D 7/1669* (2013.01)

(58) Field of Classification Search

CPC ..... F25J 5/02; F25J 2290/32; F25J 2290/60; F28D 3/02; F28D 3/04; F28D 7/0066; F28D 2021/0066; F28F 9/0265; F28F 27/02

USPC ..... 165/115, 117, 118, 299, 300; 159/13.2, 159/13.3, 43.1

See application file for complete search history.

(56) References Cited

U.S. PATENT DOCUMENTS

| | | | | |
|---|---|---|---|---|
| 3,450,105 | A * | 6/1969 | Osburn | F28F 27/02 122/451 R |
| 3,746,084 | A * | 7/1973 | Ostbo | F28D 7/04 165/145 |
| 4,223,722 | A * | 9/1980 | Shade, Jr. | 165/111 |
| 5,472,044 | A * | 12/1995 | Hall et al. | 165/115 |
| 5,588,596 | A * | 12/1996 | Hartfield et al. | 165/117 |
| 8,087,454 | B2 | 1/2012 | Kerber et al. | |
| 2008/0115918 | A1 * | 5/2008 | Kerber et al. | 165/165 |

(Continued)

FOREIGN PATENT DOCUMENTS

| | | | | |
|---|---|---|---|---|
| DE | 10 2004 040 974 A1 | | 3/2006 | |
| DE | 102007036181 | * | 2/2008 | F28D 7/028 |

OTHER PUBLICATIONS

Machine Translation of DE102007021565, retrieved Feb. 5, 2015.*
Machine Translation of DE 102007036181, Retrieved Aug. 30, 2016.*

*Primary Examiner* — Len Tran
*Assistant Examiner* — Hans Weiland
(74) *Attorney, Agent, or Firm* — Miller, White, Zelano, Branigan, P.C.

(57) ABSTRACT

The invention relates to a shell and tube heat exchanger (1) having a helical tube bundle (10) within a shell (20), that defines a shell space (200) surrounding the tube bundle (10). The tubes are helically coiled about a core pipe (100) in such a manner that there is formed at least one first section (11) and at least one second section (12), separate from the first section, that surrounds the first section (11). The two sections (11, 12) have in each case at least one associated inlet (E, E') such that the two sections (11, 12) are able to be charged separately with the first medium.

23 Claims, 3 Drawing Sheets

(56) References Cited

U.S. PATENT DOCUMENTS

| | | | | |
|---|---|---|---|---|
| 2008/0196839 | A1* | 8/2008 | Porscha et al. | 159/13.2 |
| 2010/0242533 | A1* | 9/2010 | De Larminat | F25B 39/028 62/498 |

* cited by examiner

HEAT EXCHANGER WITH SECTIONS

SUMMARY OF THE INVENTION

The invention relates to heat exchangers for the indirect heat exchange between at least one first and one second medium. Such heat exchanger can, for example, include: a tube bundle formed from a plurality of tubes, helically coiled about a core pipe, for the reception of the first medium, and a shell (or jacket), which encloses the tube bundle and defines a shell space (or jacket space) surrounding the tube bundle for the reception of the second medium, whereby the two media can enter into indirect heat exchange.

A heat exchanger of this type serves for the indirect heat exchange between at least one first and one second medium and usually has at least one tube bundle, produced from a plurality of tubes helically coiled about a core pipe, for the reception of the first medium (the tubes are helically coiled about the core pipe preferably transversely with respect to the longitudinal axis of the core pipe) as well as a shell, which encloses the tube bundle and defines a shell space surrounding the tube bundle, for the reception of the second medium such that the two media are able to enter into the indirect heat exchange. The core pipe extends in particular along a longitudinal axis, which—with reference to the typical arrangement of the heat exchanger or of the shell—coincides with the vertical. The longitudinal axis of the shell coincides in particular with the longitudinal axis of the core pipe. The shell and tube bundle are therefore preferably arranged coaxially to each other. In a preferred manner, the shell is divided into sections so as that the shell is in the shape of a substantially hollow cylindrical wherein the longitudinal axis thereof forms a cylinder axis. Such a heat exchanger can have a shell wherein the sections have different diameters and/or the heat exchanger can have more than one tube bundle.

Such a heat exchanger is known from DE 10 2004 040 974 A1.

In heat exchangers that operate by falling film evaporation, the heat transfer between shell side and tube side is based on an even quantity of heat supplied from both sides. On the tube side, the flows are distributed evenly throughout all the layers of the tube bundle. However, this even distribution can be impaired by external conditions, e.g. by gas entrainment in an otherwise purely liquid flow. On the shell side, the liquid distribution systems are designed such that a two-stage liquid/gas mixture is calmed and degassed in a preliminary distribution system. The degassed liquid is subsequently backed up via a down pipe (downcomer) to generate pressure and is supplied to the actual main distribution system. The liquid is slowed down in the lower part of the down pipe by a fixedly installed hydrodynamic brake and is further degassed. The main distribution system is load-independent and static, as a result of which changes occurring in the overall system (e.g. gas proportion, load) can affect the quality of the distribution.

The problem underlying the present invention, proceeding from this point is to improve a heat exchanger of the aforementioned type with regard to the distribution quality.

Thus, an aspect of this invention is therefore to provide a heat exchanger system of the above-mentioned type with improved distribution quality.

Upon further study of the specification and appended claims, other aspects and advantages of the invention will become apparent.

The above-mentioned problem is solved by a heat exchanger characterized in that the tubes are helically coiled about the core pipe in such a manner that there is formed at least one first section of the tube bundle encircling the core pipe and one second section of the tube bundle, which is separate from the first section. The second section also encircles the core pipe and surrounds the first section, or penetrates the first section. These two sections (each have at least one associated inlet by which the two sections are able to be charged separately with the first medium.

Accordingly, it is provided that the tubes are helically coiled about the core pipe in such a manner that there is formed at least one first section of the tube bundle which encircles the core pipe and one second section of the tube bundle which also encircles the core pipe. The second section surrounds the first section or penetrates the first section, and the two sections each have at least one associated inlet by which the two sections are able to be charged with the first medium separately from each other. The individual sections of the tube bundle in each case have a hollow cylindrical form, whereby each section encompassing those sections that are located further on the inside radially in each case along a circumferential direction of the shell or penetrating them. The radially innermost section surrounds the core pipe, the longitudinal axis of which coincides in particular with the cylinder axes of the sections. More than two sections, e.g. three sections, can be present.

The first and the second section penetrate each other when the two hollow cylinders that form these two sections overlap each other at least partially. In such a case, the radially innermost first section extends away from the core pipe up to a given radius R1. The second section extends from the core pipe from a radius R2 up to a radius R3. If the second section surrounds the first section, the radius R2 is at least as large as the radius R1. If the second section penetrates the first section, the radius R2 is smaller than R1. The two hollow cylinders, which are formed by the sections, consequently overlap at least partially. Within the framework of the invention, it is also possible for the two sections to overlap in a complete manner.

Therefore, a substantial concept of the invention is to influence the quantity of heat supplied in particular on the tube side (and, where applicable, also on the shell side) in order, thereby, to be able to react to prevailing conditions by dividing the inlets (or nozzles or connection pipes or perforated plates) of the tube bundle on the tube side such that it is possible to adjust the fluid flow in the tube bundle in sections in a radial manner. By controlling the tube flows separately in radial sections (and, where applicable, a part flow or main flow of the liquid on the shell side), it is possible to act in a targeted manner counter to improper distributions and/or discontinuities, which can be detected by temperature measurements. Such improper distributions or discontinuities can be brought about by conditions external to the heat exchanger or can be produced via thermodynamic processes within the tube bundle of the heat exchanger. By controlling the tube-side distribution of the first medium, the effective heating surface of the heat exchanger can be utilized in an optimum manner and the output, even in the case of unfavorable conditions, can be kept higher than it would be without this possibility.

In accordance with further embodiments of the invention, 3 or more sections may also be advantageous, in which the individual sections surround or penetrate each other. For example, in an analogous manner to the preceding explanations of the invention, it is advantageous when a third section surrounds a second section, which, in its turn, surrounds a first section. It is also advantageous in an alternative embodiment when a third section penetrates a second section, which in turn penetrates a first section. Combinations of sections being surrounded with sections being penetrated just as more than 3 sections are also alternative expedient embodiments of the invention.

In a preferred manner, the acting on the separate sections is separately controllable for each section. To this end, there is provided a control means which includes at least one valve for each of the inlets of the sections. In addition, the individual sections have in each case at least one associated outlet, via which the first medium can be discharged out of the shell or the tube bundle.

In addition, in a preferred manner the heat exchanger according to the invention has a liquid distributor which is used for the purpose of distributing a flow, which flows in the shell space, (also called a main flow) of a second medium in the form of a liquid over a cross section of the shell space which is oriented perpendicular with respect to the longitudinal axis of the shell (discharging it to the tube bundle) such that the liquid can enter into an indirect heat exchange with the first medium guided in the tube bundle. In this case, in a preferred manner there is provided a further control means, which is used for the purpose of (a) controlling the distribution of an additional further flow (part flow) of the liquid in the shell space, the additional further flow being guided parallel to the flow in the shell space, and/or (b) controlling the distribution of the flow (main flow) of the liquid in the shell space.

For distributing the liquid of the flow over the at least one tube bundle of the heat exchanger, the liquid distributor, in a preferred manner, has a main distributor above the tube bundle for the reception of the liquid. The main distributor has through openings through which the liquid can be delivered to the tube bundle.

The further flow, in a preferred manner, is guided in at least one additional line, which is controllable by way of the control means and which has at least one outlet above the tube bundle, via which outlet the further flow of the liquid can be delivered in a controllable manner to the tube bundle. In this case, the further control means for controlling the distribution of the further flow of the liquid to the tube bundle has at least one valve for the at least one line (e.g. for changing the effective cross section of the at least one line).

In a preferred manner, the main distributor has at least one through region or passage region, through which the tubes of the tube bundle may pass, that is to say are guided past the main distributor. These types of through regions are defined in each case by two distributor arms of the main distributor, via which the liquid can be delivered to the tube bundle. To this end, the distributor arms have in each case a plate with through holes (perforated plates), through which the liquid can rain onto the tube bundle arranged below.

In a preferred manner, the at least one line for the further flow of the liquid is also guided through a through region of the main distributor such that the at least one outlet of each line is positionable in a predefinable manner above the tube bundle.

Naturally, a plurality of lines each with at least one outlet can also be provided for guiding the further flow or further flows of the liquid to be distributed, via which lines liquid is additionally deliverable in a controllable manner to the tube bundle. The outlets of these lines for guiding the further flow can be distributed over the cross section (oriented perpendicular with respect to the longitudinal axis of the shell) of the shell space in a preferred manner such that the further flow of the liquid is variably distributable in a radial direction of the shell at least to the first section and the second section (or also to several sections) of the tube bundle and/or in a circumferential direction of the shell. In such a case, the distribution of the further flow to the sections can be controlled separately for each section.

For distributing the flow (main flow) of the liquid, the main distributor preferably has a plurality of distributor arms which are extended in particular in each case in the radial direction of the shell. In this case, the form of the distributor arms in each case is in particular in the manner of a slice of cake or slice of pie (sector-like, having a base that is a truncated triangle). The through regions are then preferably formed in a corresponding manner.

For supplying the main distributor with the flow (main flow) of the liquid to be distributed, the liquid distributor has at least one down pipe (downcomer) which is preferably arranged in the core pipe of the tube bundle and in particular has an outer diameter which is smaller than the inner diameter of the core pipe. The main distributor, in this case, is connected via the at least one down pipe to a preliminary distributor of the liquid distributor, which serves for collecting and calming the liquid.

In a variant of the invention, the distributor arms for the variable (controllable) distribution of the flow (main flow) of the liquid are divided in the radial direction into at least two (or more) separate segments, which in each case have at least one through opening, through which liquid is able to rain onto the tube bundle. In this case, control means can be set up for the purpose of controlling a supply of liquid into the two (or more) segments in a separate manner for each segment such that the liquid is variably distributable in the radial direction of the shell onto at least the first and the second section (or also onto several sections) of the tube bundle. To this end, the individual segments can have associated therewith down pipes (e.g. with valves), via which the segments can be charged in a controllable manner with the liquid of the flow (main flow) such that the distribution of the liquid to those two sections (or also to several sections) is controllable in a separate manner for each section.

In a further exemplary embodiment it is provided that at least two (or more) distributor arms are realized with the purpose of acting upon different sections of the tube bundle with liquid along the radial direction of the shell, the sections being in particular the first and the second section. In this case, the distributor arms for distributing the liquid of the flow (main flow) to the sections have at least one through opening each, through which liquid is deliverable to the tube bundle, those through openings being positioned variously along the radial direction such that sections of the tube bundle are able to be acted upon selectively with liquid (in a controllable manner) by way of the distributor arms. For charging the distributor arms with the liquid to be distributed, a plurality of down pipes are provided in a preferred manner, one down pipe acting upon at least one, in particular two, distributor arms each with liquid. In this case, those down pipes are arranged in particular in the core pipe or are formed by a division of the core pipe into sections. By controlling the supply of liquid through those down pipes (e.g. by means of valves), it is also possible to control the distribution of the flow (main flow) of the liquid to the sections of the tube bundle in a separate manner for each section.

In a preferred manner the flow through the tubes and/or the flow at the shell side are controlled depending on the measured temperature at one or more points of the heat exchanger. Advantageously the heat exchanger comprises at least one optical fiber connected to equipment suitable for determining a temperature from the signals of the optical fiber. The use of an optical fiber provides the opportunity to determine the temperature at any point or various given points of the optical fiber by the analysis of optical signals originating of Raman scattering, Brillioun scattering or of the scattering of a Bragg grating. All these signals are temperature depending and therefore suitable for the determination of the temperature. The optical fibers are preferably fastened on or inside the tubes.

BRIEF DESCRIPTION OF THE DRAWINGS

Further features and advantages of the invention are to be explained with the following description of the Figures of exemplary embodiments by way of the Figures, in which:

By way of a schematic sectional view of a heat exchanger 1, FIG. 1 shows a dividing or controlling of tube flows in sections.

Figure 1:
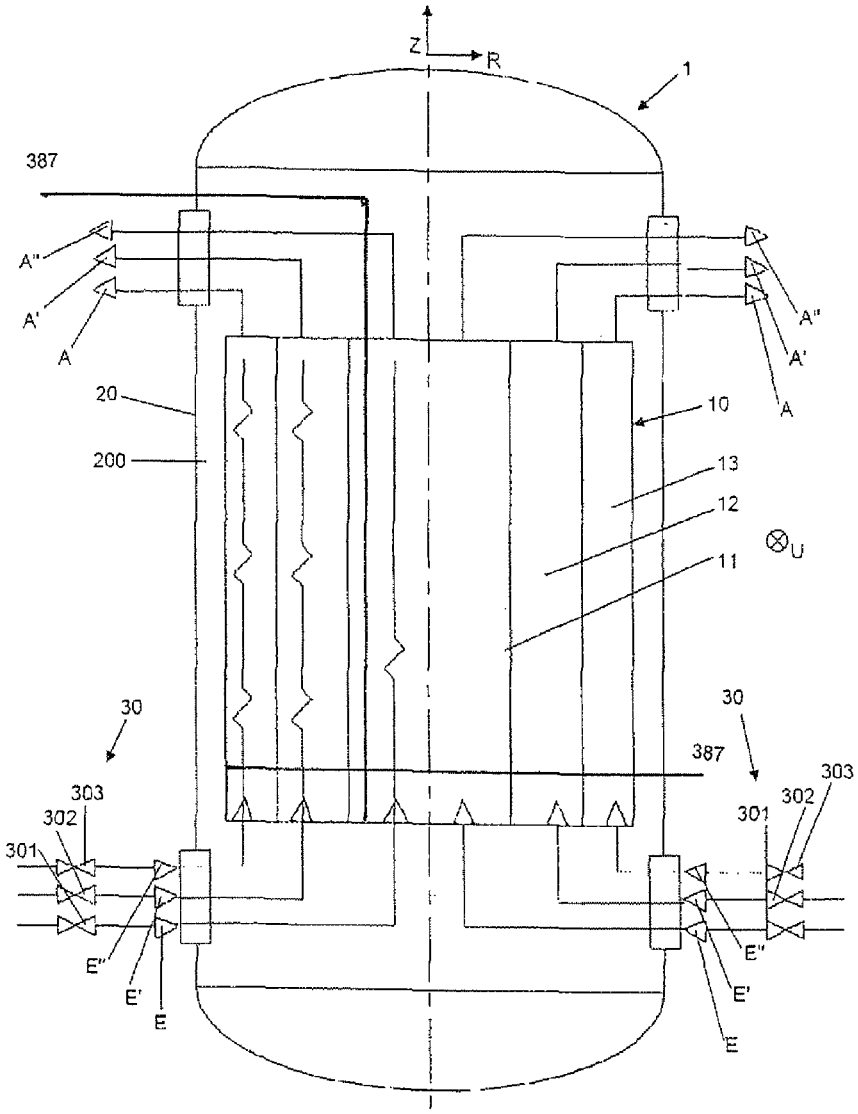
FIG. 1 shows a schematic sectional view of a heat exchanger with a tube bundle which forms radial sections that can be acted upon separately (in a controllable manner)

For this purpose, the heat exchanger 1 has a pressure-bearing shell 20, having a circumferential hollow cylindrical wall, the shell 20 extending along a longitudinal axis (cylinder axis), which—with reference to a state of the heat exchanger 1 or shell 20—coincides with the vertical Z. The shell 20 defines a shell space 200, in which a liquid F (second medium) is to be distributed to a tube bundle 10 arranged in the shell space 200. The tube bundle 10 serves for the reception of a first medium which is to enter into indirect heat exchange with the liquid F and for this purpose has several tubes which are helically coiled (not shown) transversely with respect to the longitudinal axis of the shell 20 onto a core pipe 100, the longitudinal axis of which coincides with the longitudinal axis of the shell 20, i.e. the tube bundle 10 is arranged coaxially with respect to the shell 20.

In the present case, the tubes of the tube bundle 10 are helically coiled about the core tube 100 in such a manner that, as an example, a first, a second and a third hollow cylindrical section 11, 12, 13 of the tube bundle 10 is formed. In each case, these three sections encircle the core pipe 100. The second section 12 encompasses the first section 11 of the tube bundle 10 and the third section 13 encompasses the two other sections 11, 12. These sections 11, 12, 13 can now each be charged with the first medium via at least one associated inlet E, E', E", in each case, at a lower end of the shell 20 in a manner that is controllable separately from each other (in the present case two inlets E, E', E" are provided per section at the lower end of the shell 20). To this end, associated valves 301, 302, 303 of a controlling means 30 are provided at the inlets E, E', E". The medium introduced into the tube bundle sections 11, 12, 13 can finally be removed out of the tube bundle 10 at an upper end of the shell 20 via at least one outlet A, A', A" each per section 11, 12, 13 (in the present case two outlets A, A', A" are provided per section at the upper end of the shell 20).

Advantageously, one or more optical fibers 387 are fastened on the tubes (or within the tubes) of the tube bundle 10. The temperature of the tubes can be determined from the signals of the optical fibers.

Figure 2:
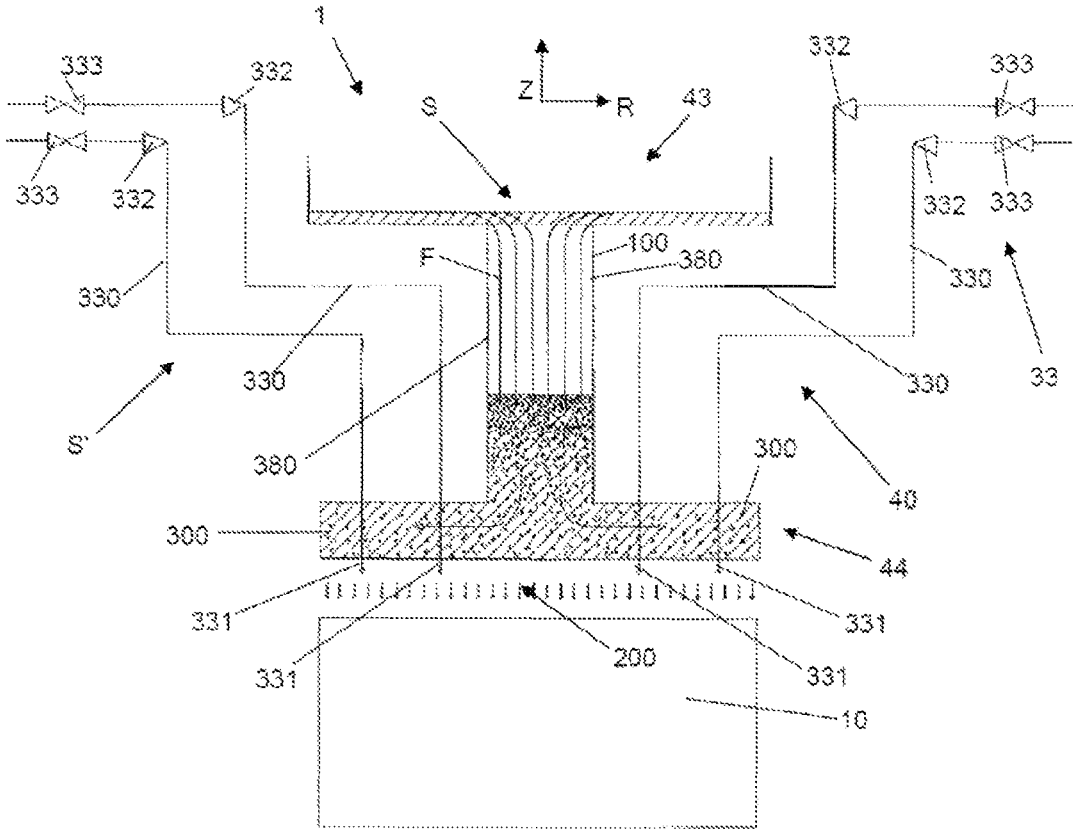
FIG. 2 shows a schematic sectional view, in the form of a cutout, of a heat exchanger with a controllable part flow of a liquid to be distributed.

FIG. 2 shows a further heat exchanger 1, which has a pressure-bearing, in particular hollow cylindrical shell 20 (not shown in FIG. 2), the longitudinal axis or cylinder axis of which—with reference to a state of the heat exchanger 1—extends along the vertical Z. In its turn, the shell 20 defines a shell space 200 in which a helically coiled tube bundle 10 is arranged. This latter, as previously, has several tubes which are helically coiled in several layers about a core pipe 100, the longitudinal axis of which coincides with the longitudinal axis of the shell 20. The tube bundle 10 is therefore arranged coaxially with respect to the shell 20.

At least one first medium, which flows upwards along the vertical Z, is supplied into the tube space (tube bundle 10). The shell space 200 serves for the reception of a second medium in the form of a liquid F which is delivered to the at least one tube bundle 10 and flows downstream in the shell space 200 along the vertical Z. As a result of the design of the tube bundle 10 as a helically coiled tube bundle 10, the first medium is consequently guided in the cross counter flow to the liquid F.

For distributing the liquid F in the shell space 200, a flow S of the liquid F introduced into the shell 20 is collected, calmed and degassed in a preliminary distributor 43. For the reception of the liquid F, the preliminary distributor 43, in this case, has a circumferential wall which extends upwards from a plate, the plate extending transversely with respect to the longitudinal axis of the shell 20. The plate of the preliminary distributor 43 is connected to a main distributor 44 via a down pipe 380, which extends into the core pipe 100, in order to supply the main distributor 44 with the flow S of the liquid F. Main distributor 44 has a plurality of distributor arms 300 (cf. FIG. 3) that extend transversely with respect to the vertical Z for distributing the flow S of the liquid F over the entire cross section of the shell space 200. In each case, the distributor arms branch off from the core pipe 100 in a radial direction R of the shell 20 in the manner of sectors of a circle such that through regions 45 are formed between the distributor arms 300 (cf. FIG. 3). Through the through regions 45 tubes of the tube bundle 10 can be guided past the main distributor 44.

The distributor arms 300, in each case, have a plate with a plurality of through openings (so-called perforated plates), through which liquid F introduced into the distributor arms 300 can rain onto the tube bundle 10 arranged below along the vertical Z.

In order also to be able to influence the distributing of the liquid F in the shell space 200 and, where applicable, to be able to counteract uneven distribution, the distributing and supplying of part of the liquid F in the form of at least one further flow S' can be guided parallel to the (main) flow S on the shell side.

To this end, additional lines 330 are provided for directing the further flow S' (or the further flows). The further flow S' is introduced into the additional lines and shell space 200 via corresponding inlets/connection pieces 332. The additional lines 330 in each case have at least one outlet 331 via which the liquid F can be delivered additionally in a controllable manner to the at least one tube bundle 10. Consequently, the lines 330 in each case have a valve 333. In order to be able to deliver the liquid F via the lines 330 in a controlled manner to the tube bundle 10, the lines 330 are guided through the through regions 45 of the main distributor 44 and the outlets 331 thereof are arranged above the tube bundle 10, in particular such that the tube bundle 10 can be acted upon with the liquid F section by section in a separately controllable manner in the radial direction R of the shell 20. In this case, the sections of the shell 20 in each case encircle the core pipe 100 and are preferably realized corresponding to FIG. 1.

Figure 3:
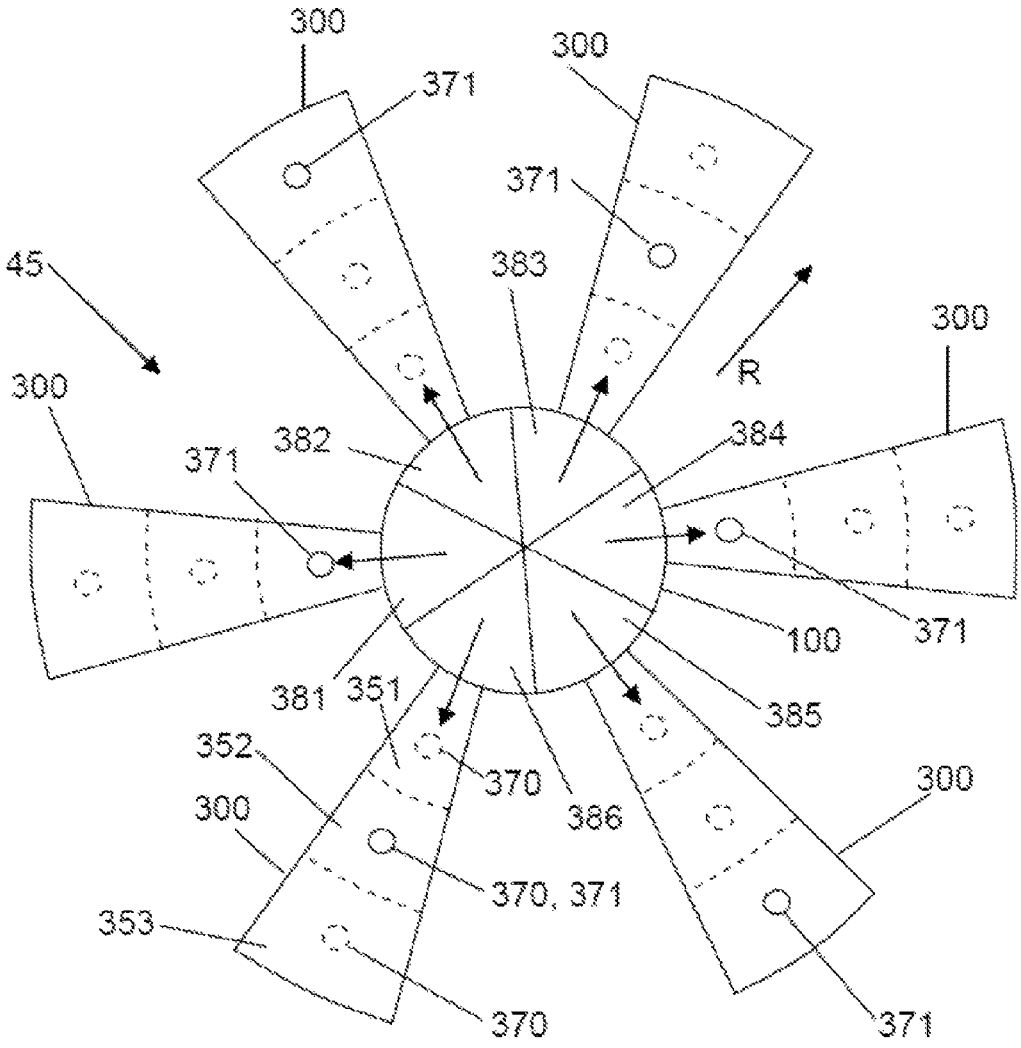
FIG. 3 shows a schematic top view of distributor arms of a liquid distributor of a heat exchanger for controlling the distribution of a main flow of a liquid to be distributed.

FIG. 3 shows possibilities for controlling the main flow S. In this case, the distributor arms 300 of a main distributor 44, shaped in the manner of sectors of a circle, in the manner of FIG. 2, are separated from each other by the through regions 45. For the variable distribution of the flow S of the liquid F in the radial direction R, distributor arms 300 are divided, for example, into at least three separate segments 351, 352, 353, which, in each case, have at least one through opening 370, through which the liquid F is able to rain onto the tube bundle 10 positioned below. If then a supply of liquid F in the segments 351, 352, 353 is controlled in a separate manner for each of the segments 351, 352, 353, e.g. by each segment 351, 352, 353 being charged via a down pipe that is controllable by means of a valve (e.g. from a preliminary distributor 43), the flow S of the liquid F can be variably distributed in the radial direction R of the shell 20 to a number of sections of the tube bundle, according to FIG. 1, corresponding to the number of segments.

As an alternative to this, the distributor arms 300 can be realized for the purpose of acting upon various sections of the tube bundle 10 according to FIG. 1 with liquid F, e.g. by means of correspondingly distributing the through holes 371 of the distributor arms 300 along the radial direction R according to FIG. 3. In order to illustrate this, the distributor arms 300 according to FIG. 3 have a through opening 371 each, which is displaced in the radial direction R with respect to the corresponding through openings 371 of the adjacent distributor arms 300. Other distributions of this type, in particular with several through holes per distributor arm 300, are also conceivable. In order now to be able to charge the individual distributor arms 300 with liquid F of the (main) flow S, it is preferably provided that the core pipe 100 is divided into sections 381-386 such that a corresponding number of down pipes is formed which are preferably developed in each case so as to be controllable (e.g. by means of valves) and in each case charge at least one associated distributor arm 300 with the liquid F (cf. FIG. 3). It is also conceivable for one section 381-386 of the core pipe 100 to act upon more than one distributor arm 300, e.g. two distributor arms 300, with the liquid F. The down pipes 381-386, in their turn, can be supplied, for example, from a preliminary distributor 43 according to FIG. 2.

The entire disclosure[s] of all applications, patents and publications, cited herein and of corresponding German Application No. 10 2011 017 031.6, filed Apr. 14, 2011, are incorporated by reference herein.

The preceding examples can be repeated with similar success by substituting the generically or specifically described reactants and/or operating conditions of this invention for those used in the preceding examples.

| List of references | |
|---|---|
| 1 | Heat exchanger |
| 10 | Tube bundle |
| 11 | First section |
| 12 | Second section |
| 13 | Third section |
| 20 | Shell |
| 30 | Control means |
| 33 | Further control means |
| 40 | Liquid distributor |
| 43 | Preliminary distributor |
| 44 | Main distributor |

-continued

| List of references | |
|---|---|
| 45 | Through region |
| 100 | Core pipe |
| 200 | Shell space |
| 300 | Distributor arm |
| 301 | Valve |
| 302 | Valve |
| 303 | Valve |
| 330 | Line |
| 331 | Outlet |
| 332 | Inlet |
| 333 | Valve |
| 351 | Segment |
| 352 | Segment |
| 353 | Segment |
| 370 | Through opening |
| 371 | Through opening |
| 380 | Down pipe |
| 381-386 | Down pipe section |
| 387 | Optical fiber |
| A, A', A" | Outlet |
| E, E', E" | Inlet |
| S | Flow |
| S' | Further flow |
| R | Radial direction |
| Z | Vertical |
| U | Circumferential direction |
| Z | Vertical |

The invention claimed is:

1. A heat exchanger for the indirect heat exchange between at least one first medium and one second medium, said heat exchanger comprising:

a tube bundle (10) formed from a plurality of tubes, helically coiled about a core pipe (100), for the reception of the first medium, and a shell (20), which encloses the tube bundle (10) and defines a shell space (200) surrounding the tube bundle (10), for the reception of the second medium whereby said first medium and said second medium can enter into indirect heat exchange, said tubes being helically coiled about the core pipe (100) in such a manner that there is formed at least a first section (11) and a second section (12), separate from said first section (11), of the tube bundle (10), said first section encircling the core pipe (100), said second section (12) encircling said core pipe (100) and surrounding or penetrating said first section (11) in a radial direction and along a circumferential direction of the shell (20), wherein each of the first (11) and second (12) sections of the tube bundle (10) have a hollow cylindrical form, and wherein said core pipe (100) has a longitudinal axis which coincides with cylindrical axes of each of said first (11) and second (12) sections of the tube bundle (10), wherein said first section (11) and said second section (12) of the tube bundle each have at least one associated inlet (E, E') whereby the two sections (11, 12) are able to be charged separately with said first medium, wherein said heat exchanger further comprises control means (30), with which a supply of the first medium via the at least one inlet (E) of the first section (11) is controllable separately from a supply of the first medium via the at least one inlet (E') of the second section (12), said control means (30) comprising at least one valve (301) for said at least one inlet (E) of said first section (11) and at least one valve (302) for said at least one inlet (E') of said second section (12), wherein said at least one valve (301) controls a supply of fluid flow of said first medium via said at least first inlet (E) to said first section (11) separately from a supply of fluid flow of said first medium via said at least second inlet (E') to said second section (12), and said at least one valve (302) controls a supply of fluid flow of said first medium via said at least second inlet (E') to said second section (12) separately from said supply of fluid flow of said first medium via said at least first inlet (E) to said first section (12), and wherein said heat exchanger further comprises a liquid distributor (40) for distributing a first flow (S) of said second medium in the form of a liquid (F) onto said tube bundle (10) in said shell space (200) such that liquid (F) can enter into indirect heat exchange with said first medium guided within said tube bundle (10).

2. The heat exchanger according to claim 1, wherein said first section (11) and said second section (12) of the tube bundle each have at least one associated outlet (A, A') for discharging said first medium out of the respective sections (11, 12) of the tube bundle (10).

3. The heat exchanger according to claim 1, wherein the tubes of said tube bundle (10) are helically coiled in such a manner about the core pipe (100) that a further third circumferential section (13) of the tube bundle (10), having a hollow cylindrical form, is formed which surrounds the second section (12) or penetrates said second section, said third section (13) having at least one associated inlet (E") such that the third section (13) is chargeable with said first medium separately from the two other sections (11, 12).

4. The heat exchanger according to claim 1, wherein the tubes of said tube bundle (10) are helically coiled in such a manner about the core pipe (100) that a further third circumferential section (13) of the tube bundle (10), having a hollow cylindrical form, is formed which surrounds the second section (12) or penetrates said second section, said third section (13) having at least one associated inlet (E") such that the third section (13) is chargeable with said first medium separately from the two other sections (11, 12), said control means (30) controls a supply of said first medium into the third section (13) of said tube bundle (10) via at least one inlet (E") of said third section (13) separately from a supply of the first medium into said other sections (11, 12), and said control means (30) includes at least one valve (303) for said at least one inlet (E") of the third section (13), and wherein the third section (13) has at least one associated outlet (A") for discharging the first medium out of said third section (13) of the tube bundle (10).

5. The heat exchanger according to claim 1, further comprising a further control means (33) for (a) controlling the distribution of an additional further flow (S') of liquid (F) in said shell space (200), said further flow being guided in said shell space, or (b) controlling the distribution of said first flow (S) of liquid (F) in said shell space (200), or (c) controlling the distribution of an additional further flow (S') of liquid (F) in said shell space (200), said further flow being guided in said shell space, and controlling the distribution of said first flow (S) of liquid (F) in said shell space (200).

6. The heat exchanger according to claim 5, wherein said liquid distributor (40) has a main distributor (44) above said tube bundle (10) for the reception of liquid (F) of said first flow (S) to be distributed, wherein said main distributor (44) has through openings through which liquid (F) can be delivered to the tube bundle (10).

7. The heat exchanger according to claim 5, further comprising at least one additional line (300) with at least one outlet (331), via which said additional further flow (S') of the liquid (F) can be delivered in a controllable manner onto the tube bundle (10), wherein the further control means (33) has at least one valve (333) for said at least one additional line (330) for controlling the distribution of said additional further flow (S') of liquid (F).

8. The heat exchanger according to claim 6, wherein said main distributor (44) comprises a plurality of distributor arms (300) via which liquid (F) can be delivered onto the tube bundle (10), and said main distributor (44) comprises a plurality of through regions (45), through which tubes of the tube bundle (10) can be guided, wherein each through region (45) is formed between two adjacent distributor arms (300) of said main distributor (44).

9. The heat exchanger according to claim 7, wherein said main distributor (44) comprises a plurality of distributor arms (300) via which liquid (F) can be delivered onto the tube bundle (10), and said main distributor (44) comprises a plurality of through regions (45), through which tubes of the tube bundle (10) can be guided, wherein each through region (45) is formed between two adjacent distributor arms (300) of said main distributor (44), and wherein said at least one additional line (330) extends through said at least one through region (45).

10. The heat exchanger according to claim 7, wherein said heat exchanger comprises a plurality of said additional lines (330), each having at least one outlet (331), via which the further flow (S') of liquid (F) can be delivered in a controllable manner onto the tube bundle (10), and wherein the outlets (331) of said additional lines (330) are distributed over a cross section of the shell space (200) such that the further flow (S') of liquid (F) is variably distributable in:

(a) a radial direction (R) of said shell (20) at least to the first and second sections (11, 12) of said tube bundle (10), or (b) a circumferential direction (U) of said shell (20), or (c) both a radial direction (R) of said shell (20) at least to the first and second sections (11, 12) of said tube bundle (10) and in a circumferential direction (U) of said shell (20).

11. The heat exchanger according to claim 6, wherein said main distributor (44) has a plurality of distributor arms (300) which each extend in a radial direction (R) of the shell (20).

12. The heat exchanger according to claim 11, wherein distributor arms (300) for the variable distribution of the first flow (S) of liquid (F) in the radial direction (R) are divided into at least two separate segments (351, 352, 353) which have in each case at least one through opening (370), through which liquid (F) can be delivered onto said tube bundle (10), and said heat exchanger comprises control means (33) for controlling a supply of liquid (F) into said at least two separate segments (351, 352, 353) in a separate manner such that the liquid (F) is correspondingly variably distributable to at least the first and second sections (11, 12) of said tube bundle (10) in the radial direction (R) of said shell (20).

13. The heat exchanger according to claim 11, wherein at least one distributor arm (300) provides said first section (11) with liquid (F) along the radial direction (R) of said shell (20) and at least one other distributor arm (300) provides said second section (12) of the tube bundle (10) with liquid (F) along the radial direction (R) of said shell (20), wherein these at least two distributor arms (300) for distributing the liquid (F) to the two sections (11, 12) each have at least one through opening (371) through which liquid (F) can be delivered onto said tube bundle (10), said through openings (371) being positioned variably along the radial direction (R), and said heat exchanger further comprises a plurality of down pipes (381-386) for supplying the distributor arms (300) with liquid (F), wherein each down pipe (381-386) provides at least one distributor arm (300) with liquid (F), and wherein said down pipes (381-386) are arranged in said core pipe (100) or are formed by a division of said core pipe (100) into sections (381-386).

14. The heat exchanger according to claim 1, further comprising at least one optical fiber connected to equipment for determining a temperature from signals of said optical fiber.

15. The heat exchanger according to claim 1, further comprising a further control means (33) for controlling the distribution of an additional further flow (S') of liquid (F) in said shell space (200), said further flow being guided in said shell space.

16. The heat exchanger according to claim 7, wherein said heat exchanger comprises a plurality of said additional lines (330), each having at least one outlet (331), via which the further flow (S') of liquid (F) can be delivered in a controllable manner onto the tube bundle (10), and wherein the outlets (331) of said additional lines (330) are distributed over a cross section of the shell space (200) such that the further flow (S') of liquid (F) is variably distributable in a radial direction (R) of said shell (20) at least to the first and second sections (11, 12) of said tube bundle (10).

17. The heat exchanger according to claim 1, wherein said liquid distributor (40) has a main distributor (44) above said tube bundle (10), said main distributor (44) being supplied with said first flow (5) of liquid (F), said main distributor (44) having a plurality of distributor arms (300), each of which extend outward from said core pipe (100) in a radial direction (R) of the shell (20), and a plurality of through regions (45), wherein adjacent distributor arms (300) are separated from each other by a through regions (45), said distributor arms (300) receiving said first flow (S) of liquid (F), and said distributor arms (300), in each case, having a plate with a plurality of through openings (370, 371) through which liquid (F) introduced into the distributor arms 300 can rain onto said tube bundle (10) arranged below said main distributor (44), and said liquid distributor (40) having a plurality of down pipes (381-386) which are formed by a division dividing said core pipe (100) into sections, wherein each of said down pipes (381-386) supplies at least one of said distributor arms with liquid (F).

18. The heat exchanger according to claim 17, wherein said distributor arms (300) are divided into a plurality of separate segments (351-353), and wherein said openings (371) are distributed along the radial direction of said distributor awls (300) and said openings (371) in each distributor arm (300) are displaced in the radial direction with respect to corresponding openings (371) of an adjacent distributor arms (300).

19. The heat exchanger according to claim 17, wherein said heat exchanger comprises a plurality of additional lines (330) via which an additional further flow (S') of liquid (F) in said shell space (200) can be delivered in a controllable manner onto the tube bundle (10), each of said additional lines (330) having at least one outlet (331) and at least one valve (332), wherein the additional lines (330) are guided through the through regions (45) of the main distributor (44) and the outlets (331) of said additional lines (330) are arranged above the tube bundle (10), and wherein the outlets (331) of said additional lines (330) are distributed over a cross section of the shell space (200) such that the further flow (S') of liquid (F) can be variably distributed in a radial direction (R) of said shell (20).

20. The heat exchanger according to claim 18, wherein said heat exchanger comprises a plurality of additional lines (330) via which an additional further flow (5') of liquid (F) in said shell space (200) can be delivered in a controllable manner onto the tube bundle (10), each of said additional lines (330) having at least one outlet (331) and at least one valve (332), wherein the additional lines (330) are guided through the through regions (45) of the main distributor (44) and the outlets (331) of said additional lines (330) are arranged above the tube bundle (10), and wherein the outlets (331) of said additional lines (330) are distributed over a cross section of the shell space (200) such that the further flow (S') of liquid (F) can be variably distributed in a radial direction (R) of said shell (20).

21. The heat exchanger according to claim 19, wherein the outlets (331) of said additional lines (330) are distributed over a cross section of the shell space (200) such that the further flow (5') of liquid (F) can be variably distributed to said first and second sections (11, 12) of said tube bundle (10).

22. The heat exchanger according to claim 20, wherein the outlets (331) of said additional lines (330) are distributed over a cross section of the shell space (200) such that the further flow (S') of liquid (F) can be variably distributed to said first and second sections (11, 12) of said tube bundle (10).

23. The heat exchanger according to claim 17, wherein each of said down pipes (381-386) supplies two of said distributor arms with liquid (F).

* * * * *